US006135092A

United States Patent [19]

Schaenzer et al.

[11] Patent Number: 6,135,092

[45] Date of Patent: Oct. 24, 2000

[54] FUEL INJECTION SYSTEM

[75] Inventors: Thomas R. Schaenzer, Rochester; Charles Wilson Braun, Livonia; Thaddeus Joseph Grey, Mendon, all of N.Y.

[73] Assignee: General Motors Corporation, Detroit, Mich.

[21] Appl. No.: 09/136,090

[22] Filed: Aug. 18, 1998

Related U.S. Application Data

[60] Provisional application No. 60/063,702, Oct. 29, 1997.

[51] Int. Cl.[7] ..... F02M 37/04

[52] U.S. Cl. ..... 123/456; 123/467; 123/468

[58] Field of Search ..... 123/456, 457, 123/459, 462, 468–9, 467; 137/510

[56] References Cited

U.S. PATENT DOCUMENTS

| | | | |
|---|---|---|---|
| 2,957,682 | 10/1960 | Cameron et al. . | |
| 4,615,320 | 10/1986 | Fehrenbach | 123/467 |
| 4,653,528 | 3/1987 | Field et al. | 137/269 |
| 4,660,524 | 4/1987 | Bertsch et al. | 123/468 |
| 4,729,360 | 3/1988 | Fehrenbach | 123/447 |
| 4,756,289 | 7/1988 | Rock et al. | 123/463 |
| 4,991,556 | 2/1991 | Mahnke et al. | 123/463 |
| 5,012,784 | 5/1991 | Fehrenbach | 123/463 |
| 5,070,845 | 12/1991 | Avdenko et al. | 123/470 |
| 5,082,184 | 1/1992 | Stettner et al. | 239/408 |
| 5,152,269 | 10/1992 | Murphy | 123/470 |
| 5,207,203 | 5/1993 | Wagner et al. | 123/514 |
| 5,312,050 | 5/1994 | Schumann et al. | 239/585.1 |
| 5,341,785 | 8/1994 | Meaney | 123/462 |
| 5,353,767 | 10/1994 | Carbone et al. | 123/470 |
| 5,398,656 | 3/1995 | Brisbane et al. | 123/470 |
| 5,429,094 | 7/1995 | Akiba et al. | 137/510 |
| 5,447,140 | 9/1995 | Brisbane et al. | 123/456 |
| 5,505,181 | 4/1996 | McRae et al. | 123/510 |
| 5,577,478 | 11/1996 | Tuckey | 123/456 |
| 5,579,739 | 12/1996 | Tuckey et al. | 123/467 |
| 5,671,890 | 9/1997 | Cooper et al. | 239/533.7 |
| 5,715,996 | 2/1998 | Cooper et al. | 239/533.7 |
| 5,845,621 | 12/1998 | Robinson et al. | 123/456 |
| 5,954,031 | 9/1999 | Ogiso et al. | 123/447 |
| 5,967,177 | 10/1999 | Bueser | 137/510 |
| 5,975,115 | 11/1999 | Schwegler et al. | 137/510 |

FOREIGN PATENT DOCUMENTS

| | | |
|---|---|---|
| 0427977A1 | 10/1990 | European Pat. Off. . |
| 19650784A1 | 6/1998 | Germany . |
| WO98/31932 | 1/1998 | WIPO . |

*Primary Examiner*—Thomas N. Moulis
*Attorney, Agent, or Firm*—John A. VanOphem

[57] ABSTRACT

A fuel injection system includes a fuel body having a compact fuel chamber connected through individual flexible fuel tubes with separate fuel injectors mounted on the separate cylinder inlet passages of an engine. The system may have an integral fuel pressure regulator or the regulator may be located separately, for example with the fuel pump in a vehicle fuel tank. The pressure regulator may include a unitized diaphragm and valve assembly which may be dropped into a housing with a valve seat in the fuel body and enclosed by cover and spring means to form an integrated system. The unitized assembly can also be used in other applications. Pulsation damping may be provided by a flexible wall of the fuel chamber. The flexible wall may be the pressure regulator diaphragm or a resilient wall designed for the purpose.

13 Claims, 6 Drawing Sheets

FUEL INJECTION SYSTEM

CROSS REFERENCE TO RELATED APPLICATION

This application claims the benefit of U.S. Provisional Application 60/063,702 filed Oct. 29, 1997.

TECHNICAL FIELD

This invention relates to fuel injection systems for use with automotive vehicle engines and the like.

BACKGROUND OF THE INVENTION

It is known in the art relating to fuel injection systems to provide controlled fuel pressure to one or more fuel rails for delivering fuel to individual fuel injectors mounted to separate cylinder inlet passages of an automotive vehicle engine. It is also known to provide one or more fuel injectors connected at a central location to individual flexible fuel tubes for delivering metered fuel to individual spray nozzles feeding separate engine cylinder inlet passages. Fuel rail systems require relatively specific designs for each differing engine application and are subject to differences in fuel flow to the various injectors. Central injection systems generally require fuel tubes to be of equal length in order to maintain equal pressure drop and fuel flow conditions in the cylinders.

SUMMARY OF THE INVENTION

The present invention provides a simplified fuel injection system including a fuel body having a compact fuel chamber connected through individual flexible fuel tubes with separate fuel injectors mounted to the separate cylinder inlet passages of an engine. The system may have an integral fuel pressure regulator or the regulator may be located separately, for example with the fuel pump in the vehicle fuel tank. The pressure regulator may include a unitized diaphragm and valve assembly which may be dropped into a housing with a valve seat in the fuel body and enclosed by cover and spring means to form an integrated system. The unitized assembly can also be used in other applications.

Pulsation damping if needed may be provided by a flexible wall of the fuel chamber. The flexible wall may be the pressure regulator diaphragm or another resilient wall designed for the purpose. Outlet connectors may optionally be equally spaced about a symmetrical wall of the fuel chamber to maintain uniform flow conditions if needed.

The system of the invention eliminates the common rail and significantly reduces the number of parts and the mass compared to a traditional fuel rail system. The complexity caused in engine design by having to package around a rigid rail is avoided as the flexible tubes may be routed around any interfering components. Because the injectors are located at the engine intake ports, the fuel pump delivers a nearly constant pressure with virtually all the pressure drop occurring at the injectors and providing equal fuel delivery. Thus, lower fuel pump pressures are required as compared to central injection systems which must provide constant pressure drop across the injectors and an additional pressure drop at the nozzle valves to avoid vapor formation in the tubes. Central injection systems also need fuel tubes of equal length which are not required with the present system.

These and other features and advantages of the invention will be more fully understood from the following description of certain specific embodiments of the invention taken together with the accompanying drawings.

DESCRIPTION OF THE PREFERRED EMBODIMENT

Figure 1:
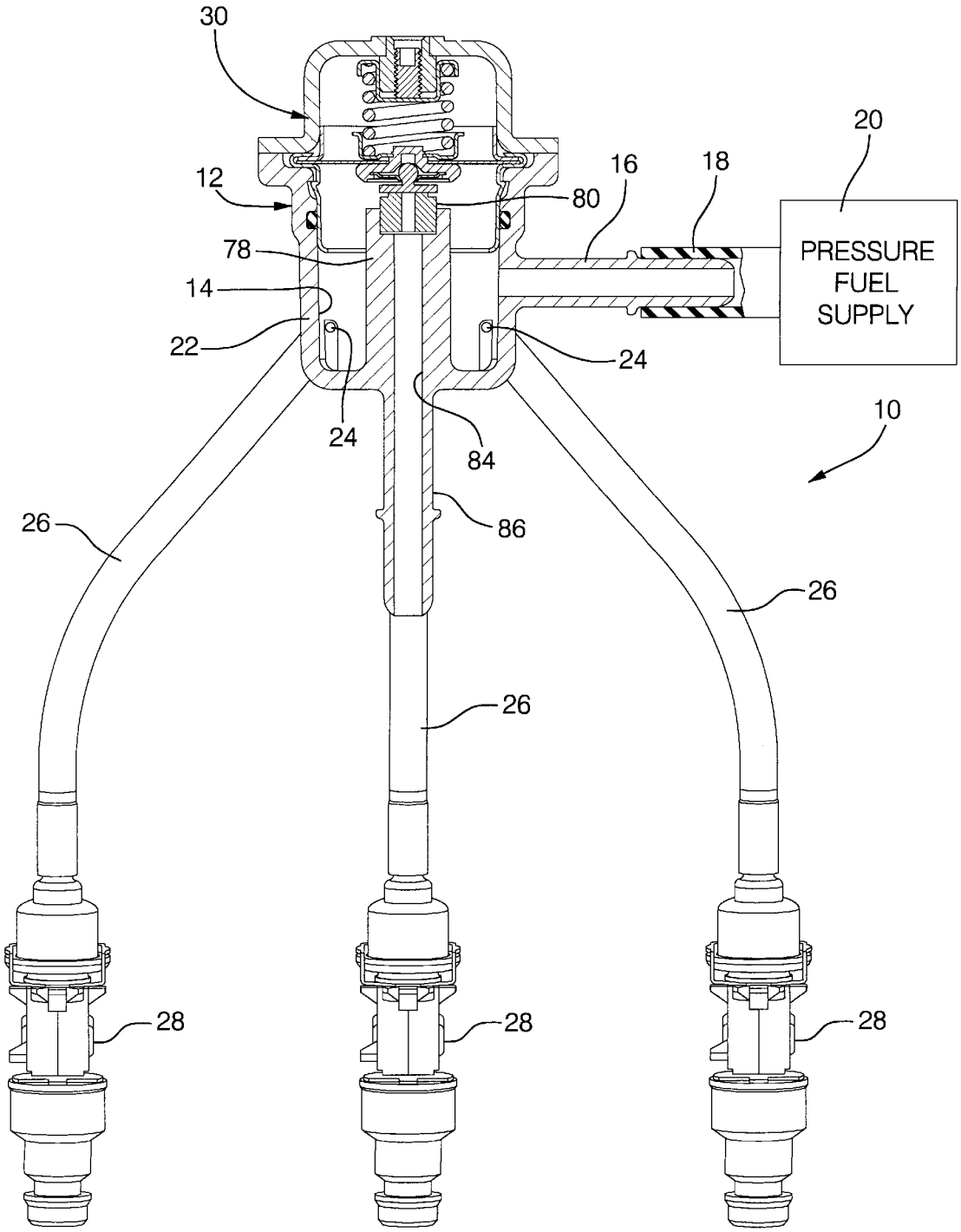
FIG. 1 is a cross-section view of a first embodiment of fuel injection system according to the invention having an integral fuel body and pressure regulator.

Referring first to FIG. 1 of the drawings in detail, numeral 10 generally indicates a first embodiment of fuel injection system according to the invention. System 10 is intended for use in an automotive vehicle and may be installed within the interior of a conventional engine intake manifold or, if desired, on the exterior thereof.

Fuel injection system 10 includes a fuel body 12 which internally defines a compact fuel chamber 14 connected with an inlet connector 16. Connector 16 is connected by a fuel line 18 with an external pressure fuel supply 20, for example a fuel pump located in the fuel tank of an associated vehicle, not shown. The fuel body 12 may be provided with a cylindrical side wall 22 of circular cross section, although other forms of symmetrical or non-symmetrical side walls could be utilized if desired. The inlet connector 16 communicates with the fuel chamber 14 through the side wall 22 wherein are provided a plurality of distribution ports 24.

Ports 24 are connected by connectors, not shown, with flexible fuel tubes 26 which connect between the fuel chamber 14 and a plurality of individual fuel injectors 28. In the present instance, the system includes six equally spaced distribution ports 24, only two of which are shown, connecting with six fuel tubes 26 each of which connects with one of six fuel injectors 28, only three of which are shown. The injectors 28 are preferably of the electrically actuated or solenoid type which include an electrically actuated injection valve directly feeding a spray nozzle not shown. The injectors are preferably mounted on inlet passages of an associated intake manifold or cylinder head to directly feed the inlet ports of an associated engine not shown.

Operation of the fuel injectors requires that a relatively constant pressure be maintained in the fuel tubes 26 so that a predetermined equal pressure drop is provided across each of the injectors and the mass of fuel injected each cycle is equalized between the various injectors as determined by the timing of the open periods of their respective injection valves which are electrically controlled. To provide the controlled fuel pressure, a fuel pressure regulator 30 is integrated with the fuel body 12.

Figure 3:
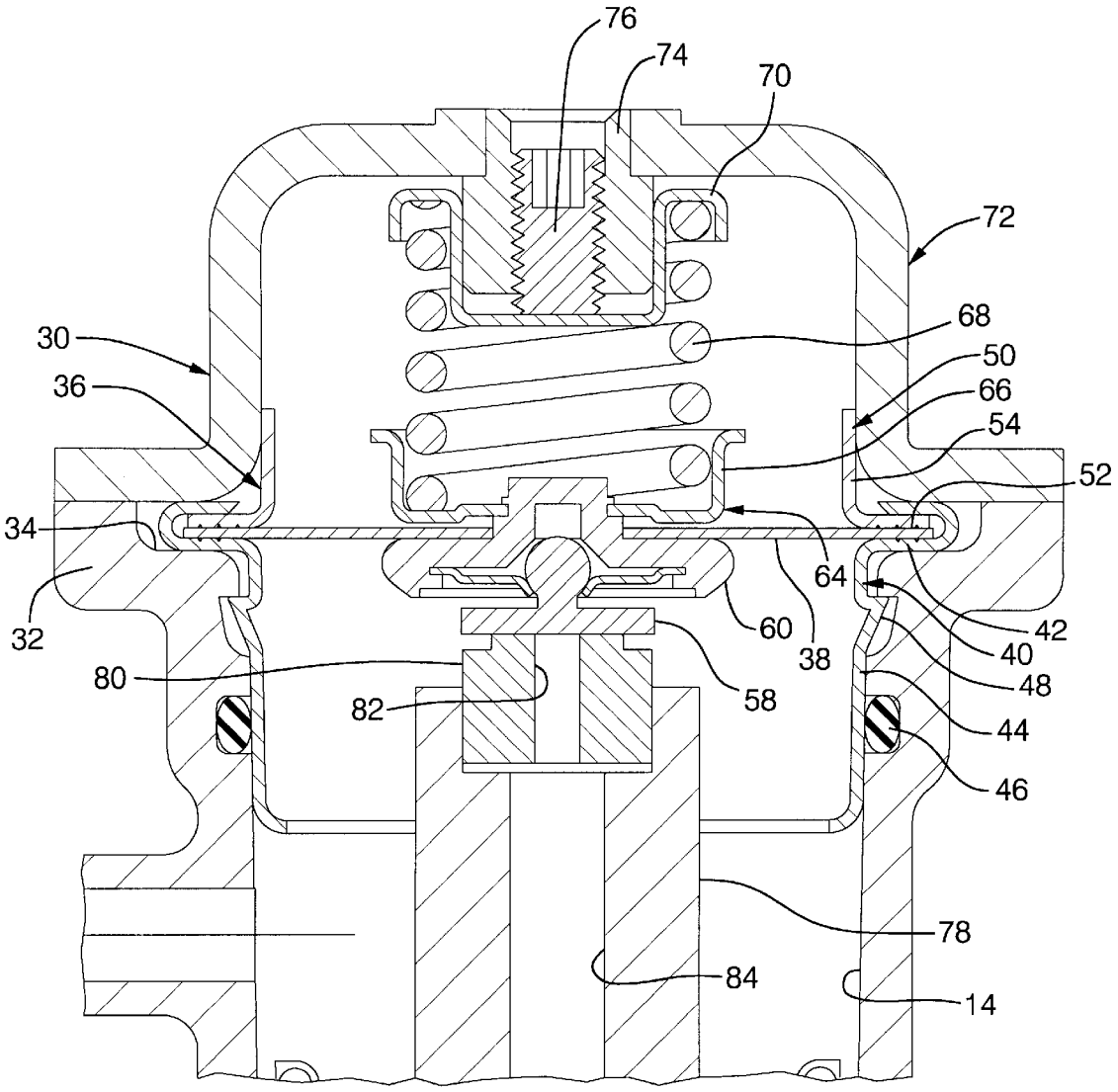
FIG. 3 is an enlarged cross-sectional view of the fuel pressure regulator in the embodiments of FIGS. 1 and 2 incorporating a unitized diaphragm and valve assembly according to the invention.

The construction of the fuel pressure regulator 30 is best shown in FIG. 3. There it is seen that the fuel chamber 14 includes an open upper end having a flange 32 with an annular recess 34 for receiving a unitized diaphragm and valve assembly generally indicated by numeral 36 and shown separately in FIG. 4.

Assembly 36 includes a pressure regulator diaphragm 38 having a circular outer periphery. An inner retention member 40 includes a first flange 42 engaging the outer periphery of the diaphragm on the lower, or inner, side thereof. An open ended tubular mounting portion 44 extends inwardly from the inner edge of flange 42 into engagement with the side wall 22 of the fuel chamber. Tubular portion 44 engages an O-ring seal 46 received in a groove of the wall 22 for sealing the connection against the escape of fuel. Angled projection means 48 bent out from the tubular portion 44 engage recesses or an annular groove in the side wall 22 of the fuel chamber for retaining the diaphragm and valve assembly 36 in its installed position.

Assembly 36 further includes an outer retention member 50 having a second flange 52 sealingly engaging the upper, or outer side, of the outer periphery of diaphragm 38. An open ended tubular portion 54 extends upward, or outward, from an inner edge of the second flange 52. In order to retain the diaphragm between the flanges 42, 52, one of them, in this case flange 42, is bent around the outer peripheries of the diaphragm 38 and the other flange 52 and is crimped against flange 52 to form an integral assembly.

A valve member 58 is pivotally retained in a socket of a valve carrier 60 that is carried by the center or central portion of the diaphragm 38 for movement of the valve together with the central portion of the diaphragm. A spring seat 64, carried on the upper side of the diaphragm central portion, engages an extension of the valve carrier 60 to retain both elements in position on the diaphragm. The spring seat 64 connects outwardly with a tubular axial extension 66. The diaphragm and valve assembly 36 as described is designed to be separately assembled and subsequently mounted in position on the upper end of the side wall 22 of the fuel body 12 as previously described.

To provide a pressure controlling biasing force against the diaphragm 38 of assembly 36, a coil type biasing spring 68 is compressed between the spring seat 64 and an upper spring retainer 70. A cover 72 encloses the biasing spring and seats upon the flange 32 of the fuel body to capture the crimped flanges of the diaphragm and valve assembly 36 in the recess 34 and retain the assembly in its assembled position. A retainer guide 74 is mounted in a central portion of the cover 72 and carries an adjusting screw 76 which engages the upper spring retainer 70 and may be adjusted to set the desired spring force.

Referring again to both FIGS. 1 and 3, the fuel body 12 further includes a central post 78 extending upward from a lower wall of the fuel chamber 14 and carrying a valve seat 80 at its upper end. An outlet orifice 82 in the valve seat connects with an outlet passage 84 extending through the post and an external nipple 86, to which a return fuel tube, not shown, may be connected for returning bypass fuel to the vehicle fuel tank.

In operation, pressurized fuel is delivered from the fuel supply 20 to the fuel chamber 14 wherein the pressure is controlled to a predetermined constant level by action of the fuel pressure regulator 30. Valve member 58 seats against the valve seat 80, closing the outlet orifice 82 until the pressure within the chamber 14 reaches the desired level. Thereafter, the diaphragm 38 is forced upward by the fuel pressure against the bias of spring 68, opening the valve 58 and allowing excess fuel to pass through the orifice 82 and passage 84 for return to the fuel tank. The flow is varied as required by the diaphragm valve in order to maintain an essentially constant pressure within the fuel chamber 14.

Constant pressure from the fuel chamber 14 is supplied through flexible fuel tubes 26 to the injectors 28, pressure in the fuel tubes being maintained at essentially the same pressure as in the fuel chamber 14. As each injector is actuated to spray fuel into its respective cylinder inlet port, fuel from the fuel chamber 14 passes into the respective fuel tube 26 to maintain the fuel supply pressure to the injector constant until it is again closed and one of the other injectors is opened. In this manner the injectors are provided with an essentially constant inlet pressure, providing a predetermined pressure drop through the injector which gives the desired equality of flow through the several injectors. Since the pressure in the fuel lines is maintained essentially constant at all times, the lines may be of any desired length in order to connect the fuel chamber 14 with each of the various injectors without having an adverse effect on the amount of fuel delivered by the various injectors to their respective cylinders.

Figure 2:
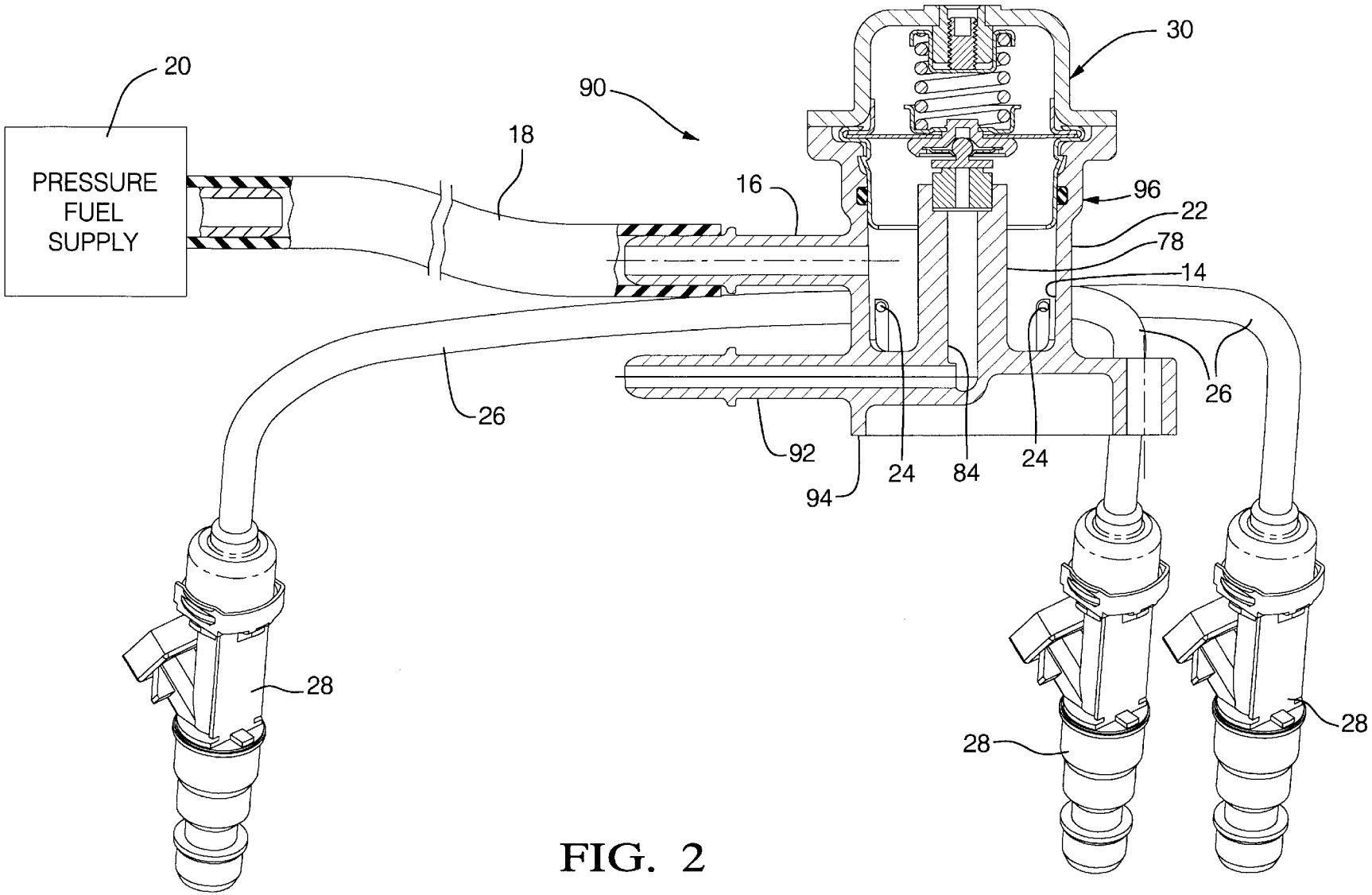
FIG. 2 is a view similar to FIG. 1 showing a second embodiment with a modified fuel body.

Referring now to FIG. 2 of the drawings, there is shown a modified fuel injection system generally indicated by numeral 90. System 90 is in most respects the same as that of system 10 previously described, so that like numerals identify like components and features. System 90 differs in providing a bypass outlet connector 92 which extends at a right angle to the outlet passage 84 in the post 78 from which the bypass outlet connector 92 extends. A mounting base 94 is provided on the lower portion of the fuel body 96 for mounting the body on a suitable portion of an associated engine, not shown. Otherwise, the structure of fuel system 90 is essentially the same as that of fuel system 10 previously described.

Figure 5:
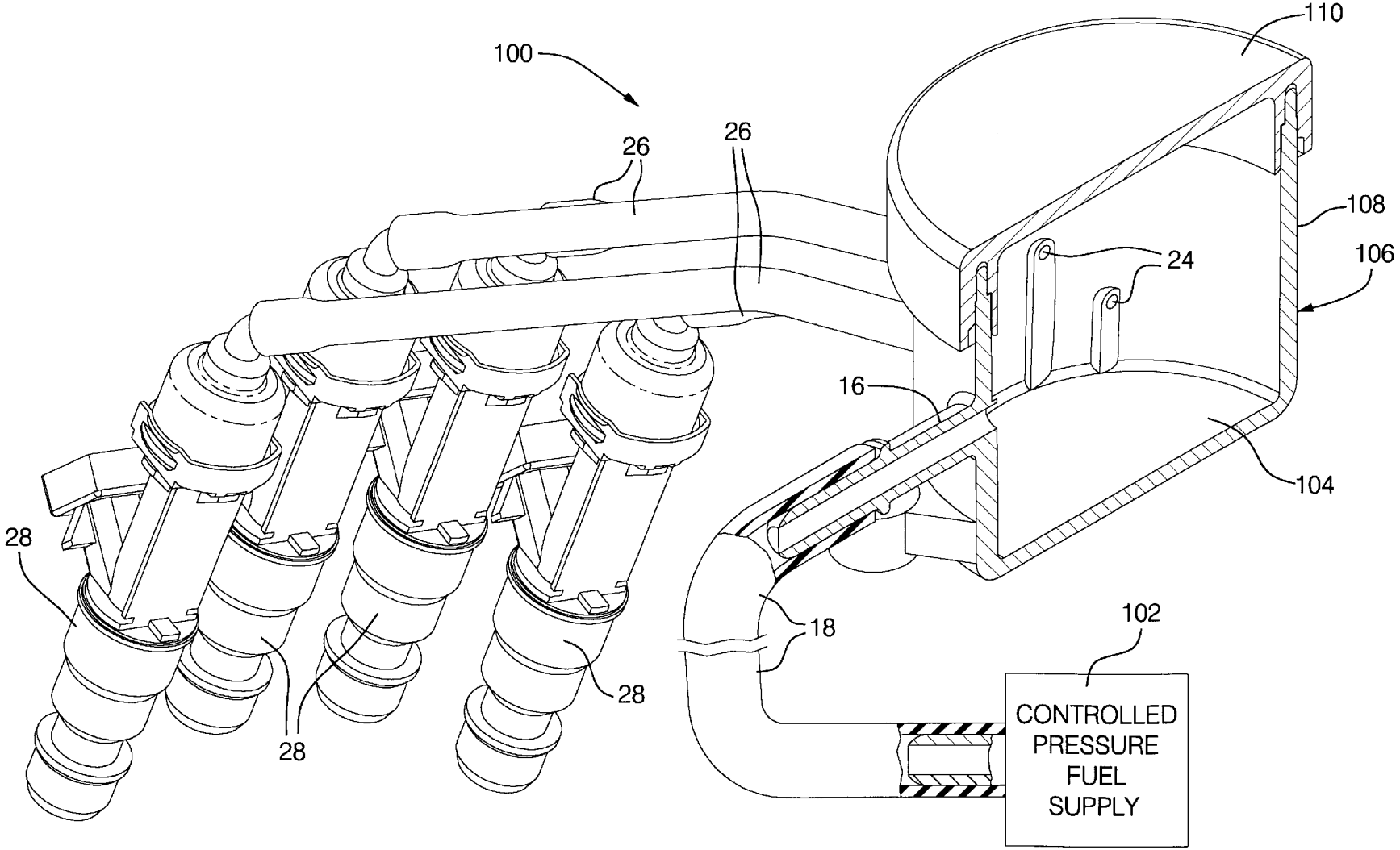
FIG. 5 is a view similar to FIGS. 1 and 2 showing a third embodiment of fuel injection system having a compact fuel body with a pulsation damping wall according to the invention for use with an in-tank fuel pump and pressure regulator.
Figure 6:
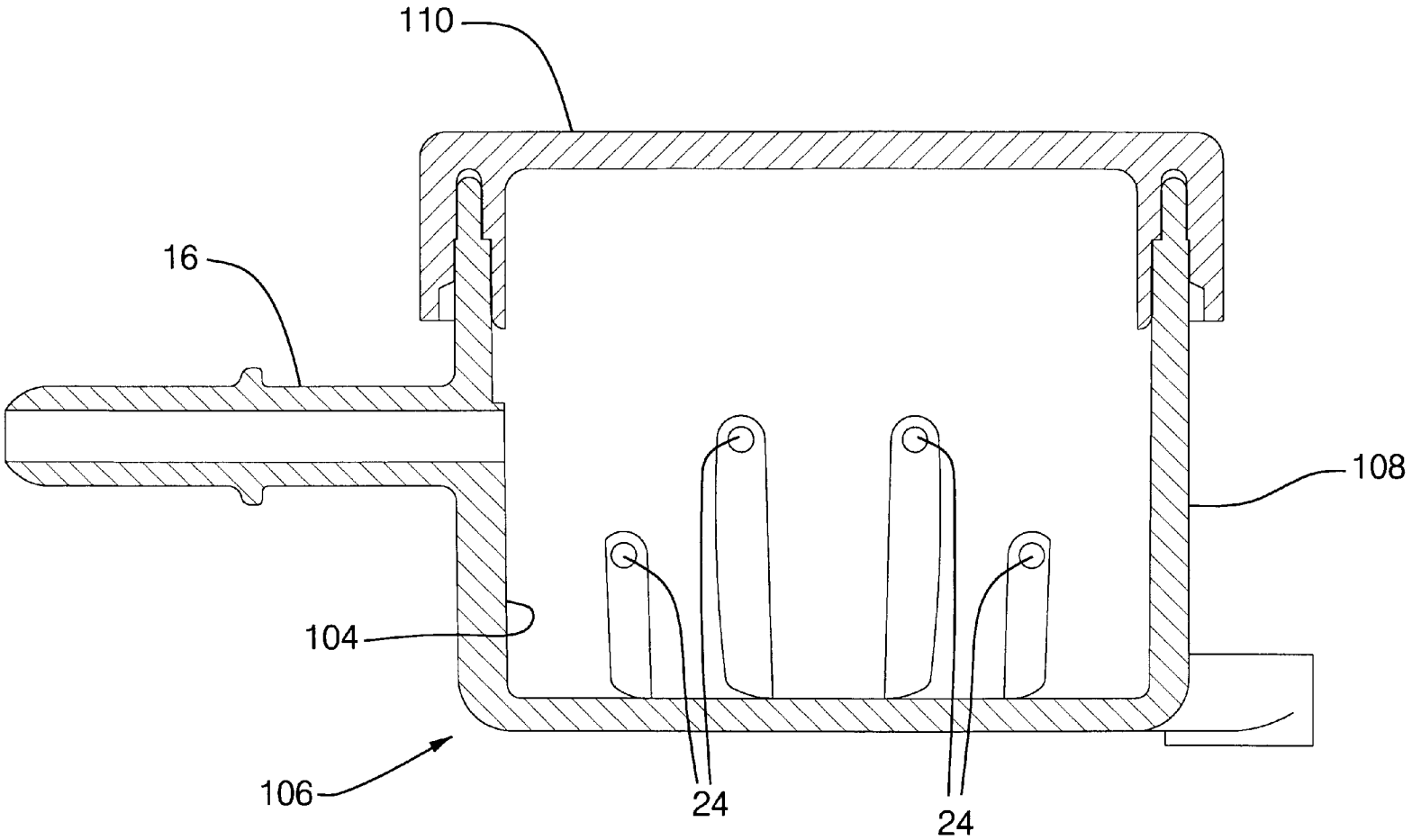
FIG. 6 is a cross-sectional view of the fuel body of the embodiment of FIG. 5.

Referring now to FIGS. 5 and 6, there is shown a third embodiment of fuel injection system generally indicated by numeral 100. System 100 has injectors and fuel tubes identical with those of system 10 so that like reference numerals identify like parts. System 10 differs in that it is connected with a controlled pressure fuel supply 102 which may be, for example, a fuel pump combined with a pressure regulator mounted within the fuel tank of an associated vehicle. Fuel supply 102 connects through a feed line 18 with an inlet tube 16 that feeds the controlled pressure fuel to a fuel chamber 104 of a fuel body 106.

The fuel body may be a compact structure having a cylindrical wall 108 with spaced distribution ports 24 extending through the wall 108 as in the first described embodiment. The bottom of the wall may be flat as shown or of any other suitable configuration. An open upper end of the enclosed fuel chamber 104 is closed by a cover 110 which is designed to flex in response to variations or pulsations in the fuel chamber 104. This flexing provides a damping effect that damps out pulsations without their having a significant effect on the fuel pressure delivered to the individual injectors.

Figure 4:
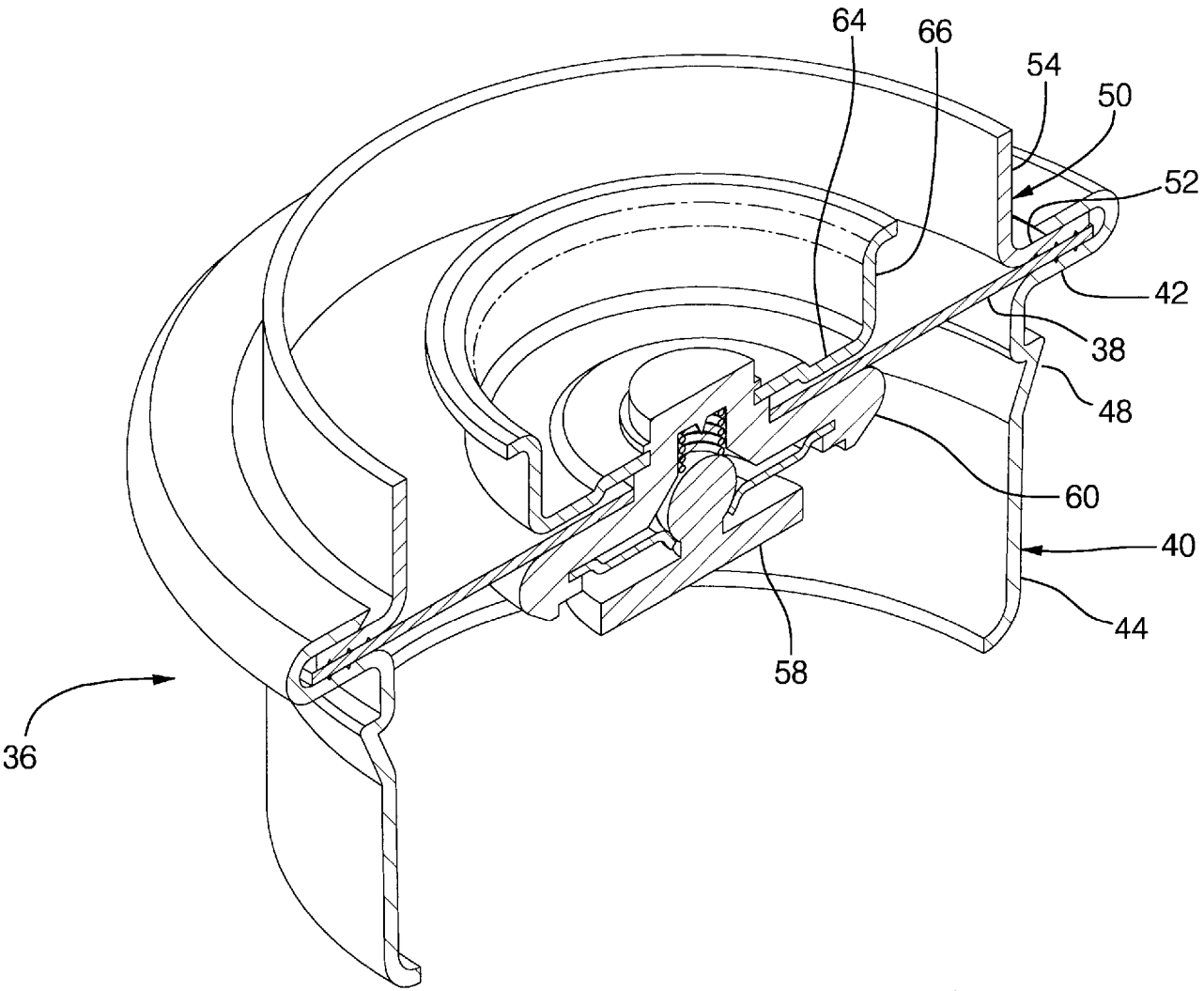
FIG. 4 is a cross-sectional pictorial view of the unitized diaphragm and valve assembly of FIG. 3.

In the embodiments of FIGS. 1 and 2, the pulsation damping is provided by the action of the pressure regulator diaphragm 38 which varies slightly the volume of the fuel chamber 14 in response to such pressure pulsations. In the embodiment of FIG. 4, wherein the fuel pressure regulator is mounted at a distance from the fuel chamber 104, the cover 110 flexes to provide the pressure pulsation damping accomplished by the diaphragm of the other described embodiments. These pressure pulsations are generated in the fuel chamber primarily by the closing of the injection valves of the individual injectors which has the effect of sending return waves through the individual fuel tubes back into the fuel chamber 104. These pulsations are damped in part by their entry into the larger chamber wherein each pressure wave expands and moves a substantial body of fuel which tends to dampen the pulsation or wave. However, pressure waves reaching the cover 110 are further damped by flexing of the cover so that the waves do not persist and affect the delivery of fuel to the various injectors as they are operated in sequence.

Various design considerations could be evaluated in designing a fuel body for a returniess fuel system as shown in FIG. 5. These considerations may include the following:

The size requirements and their relation to function

Wall thickness required

Wall stress equation and recommended design stress

Molding recommendations

The main objects in designing a fuel chamber for a returnless fuel system, simply stated, are incorporating enough compliance and not over stressing the material. Removal of the regulator removes a large percentage of the system's compliance. To compensate for this compliance loss, the fuel body must be designed with a geometry that provides the compliance and limits the maximum stresses to a manageable level. It should be noted here that the fuel body can be made of a resilient metal such as steel or, if the proper geometry is used, a composite material (material changes will drive dimensional differences). The following discussion will aid in the understanding of the relation between pressure pulsations and the geometry of the fuel body in a returnless fuel system.

From the following equation we can see that pressure pulsations are a function of wave speed, the fluid density and the change in the velocity of the bulk fluid.

$$\Delta P = -\rho c \Delta V \qquad \text{Equation 1}$$

Where:

$\Delta P$=the change in pressure (mean to peak)

$\rho$=the density of the fuel c=the wave speed of the fuel (based on the square root of the bulk modulus of the fuel divided by density)

$\Delta V$=change in velocity of the bulk fuel The fluid density of gasoline remains relatively constant. The wave speed is a function of the bulk modulus of the fluid. The change in velocity refers to the change in flow velocity due to one injector closing.

In a rigid conduit, the wave speed is equal to the square root of the bulk modulus of the fluid divided by its density. This assumes that the only change in system volume arises from the slight compression of the fuel in the wave front. If some small amount of wall flexing of the duct occurs, the system volume also changes and results in a reduction of the wave speed. The new value for wave speed is dependent on the conduit or duct size, geometry, thickness and material. The following equation models the modified wave speed.

$$c' = \sqrt{\frac{E_f}{\rho\left[1 + \frac{E_f}{E} K_g\right]}} \qquad \text{Equation 2}$$

Where:

$E_f$=the bulk modulus of the fluid

E=the modulus of elasticity of the conduit $K_g$=geometrical constant of the conduit The constant $K_g$ may be conventionally derived for any of various geometrical shapes that may be selected for a fuel body including a pressure responsive wall.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A fuel injection system for use with a pressurized fuel source, said system comprising:

a fuel body defining a cylindrical fuel chamber with at least one side wall and two end walls for receiving fuel at a controlled pressure, said body having an inlet connector, multiple outlet connectors, and at least one of the end walls operative to dampen pressure pulsations acting on said wall by varying the volume of the chamber in response to such pressure pulsations;

a plurality of fuel injectors mountable to cylinder inlet passages of an internal combustion engine for metering fuel directly to separate inlet ports of an internal combustion engine; and a plurality of flexible fuel tubes connecting said fuel injectors with separate ones of said outlet connectors for distributing fuel to said injectors at said controlled pressure.

2. A fuel injection system as in claim 1 wherein said fuel injectors have solenoid actuated injection valves.

3. A fuel injection system as in claim 1 wherein said fuel chamber is generally symmetrical.

4. A fuel injection system as in claim 1 wherein the interior dimensions of said outlet connectors and said fuel tubes are selected to minimize pressure drop during the flow of fuel from the fuel chamber to the respective injectors.

5. A fuel injection system as in claim 1 wherein said pressure responsive wall is formed as an edge supported membrane made from a relatively rigid material.

6. A fuel injection system as in claim 5 wherein said relatively rigid material is selected from the group consisting of resilient metals and plastics.

7. A fuel injection system for use with a pressurzed fuel source, said system comprising:

a fuel body defining a compact fuel chamber for receiving fuel at a controlled pressure, said body having an inlet flow connector, multiple outlet connectors, and a pressure responsive wall of said fuel chamber operative to dampen pressure pulsations acting on said wall by varying the volume of the chamber in response to such pressure pulsations, wherein said pressure responsive wall includes a fuel pressure regulator diaphragm;

a plurality of fuel injectors mountable to cylinder inlet passages of an internal combustion engine for metering fuel directly to separate inlet ports of an internal combustion engine; and a plurality of flexible fuel tubes connecting said fuel injectors with separate ones of said outlet connectors for distributing fuel to said injectors at said controlled pressure.

8. A fuel injection system as in claim 7 wherein said diaphragm opens a bleed valve in response to excessive pressure in the fuel chamber thereby further damping pressure pulsations therein.

9. A fuel injection system as in claim 8 wherein said diaphragm forms part of a unitized diaphragm and valve assembly further comprising:

an inner retention member having a first flange sealingly engaging an outer periphery of the diaphragm on one side thereof and a tubular mounting portion extending from an inner edge of the flange axially inward away from the diaphragm and seated in a peripheral wall of said chamber;

an outer retention member having a second flange sealingly engaging said outer periphery of the diaphragm on an opposite side thereof and a tubular outer portion extending from an inner edge of the second flange axially outward;

one of said first and second flanges being bent around said outer periphery of the diaphragm and crimped against the other of said first and second flanges to sealingly retain said diaphragm periphery between said first and second flanges;

a valve member carried on a central portion of said diaphragm on the same side as said inner retention member for movement with said diaphragm central portion axially of said tubular portions; and a spring seat carried on said central portion of the diaphragm on the same side as said outer retention member for movement with said diaphragm central portion, said spring seat connecting outwardly with a tubular axial extension adapted to receive a biasing spring in engagement with the spring seat.

10. A fuel injection system as in claim 9 wherein said inner retention member includes projection means engageable with recesses in said peripheral wall to maintain said diaphragm and valve assembly seated in said chamber peripheral wall.

11. A fuel injection system as in claim 9 including a cover mounted on said peripheral wall of the chamber and outwardly enclosing said diaphragm and valve assembly and a biasing spring compressed between said spring seat and said cover and urging said valve member against a valve seat within said chamber for controlling fuel pressure regulation by said diaphragm and valve assembly.

12. A unitized diaphragm and valve assembly comprising:

a pressure regulator diaphragm;

an inner retention member having a first flange sealingly engaging an outer periphery of the diaphragm on one side thereof and an open ended tubular mounting portion extending from an inner edge of the flange axially inward away from the diaphragm;

an outer retention member having a second flange sealingly engaging said outer periphery of the diaphragm on an opposite side thereof and an open ended tubular outer portion extending from an inner edge of the second flange axially outward;

one of said first and second flanges being bent around said outer periphery of the diaphragm and crimped against the other of said first and second flanges to sealingly retain said diaphragm periphery between said first and second flanges;

a valve member carried on a central portion of said diaphragm on the same side as said inner retention member for movement with said diaphragm central portion axially of side tubular portions; and a spring seat carried on said central portion of the diaphragm on the same side as said outer retention member for movement with said diaphragm central portion, said spring seat connecting outwardly with a tubular axial extension adapted to receive a biasing spring in engagement with the spring seat.

13. A unitized diaphragm and valve assembly as in claim 12 wherein said tubular mounting portion of the inner retention member includes retaining projections for engaging recesses in an associated chamber peripheral wall.

* * * * *